US012133580B2

(12) United States Patent
Lee et al.

(10) Patent No.: US 12,133,580 B2
(45) Date of Patent: Nov. 5, 2024

(54) WEARING MEMBER AND WEARABLE DEVICE INCLUDING THE SAME

(71) Applicant: SAMSUNG ELECTRONICS CO., LTD., Suwon-si (KR)

(72) Inventors: Junghun Lee, Suwon-si (KR); Jungwon Lee, Suwon-si (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 1 day.

(21) Appl. No.: 18/102,569

(22) Filed: Jan. 27, 2023

(65) Prior Publication Data

US 2023/0232945 A1 Jul. 27, 2023

Related U.S. Application Data

(63) Continuation of application No. PCT/KR2023/001188, filed on Jan. 26, 2023.

(30) Foreign Application Priority Data

Jan. 27, 2022 (KR) ..... 10-2022-0012745

(51) Int. Cl.
*A44C 5/22* (2006.01)
*A44C 5/18* (2006.01)

(52) U.S. Cl.
CPC ..... *A44C 5/185* (2013.01)

(58) Field of Classification Search
CPC ..... A44C 5/2042; A44C 5/2071; A44C 5/22; A44C 5/185; A44D 2203/00; A44B 11/06
See application file for complete search history.

(56) References Cited

U.S. PATENT DOCUMENTS 811,767 A * 2/1906 Drews ..... A44C 5/22 224/176
1,396,019 A * 11/1921 Buchsbaum ..... A44C 5/22 24/170

(Continued)

FOREIGN PATENT DOCUMENTS

CN 1040687 A 3/1990
CN 105182726 A 12/2015

(Continued)

OTHER PUBLICATIONS

International Search Report mailed Apr. 27, 2023 for PCT/KR2023/001188, citing the above reference(s).

*Primary Examiner* — Jack W Lavinder
(74) *Attorney, Agent, or Firm* — CANTOR COLBURN LLP

(57) ABSTRACT

A wearing member includes: a strap part including a first portion and a second portion extending from the first portion, and a fastening part slidable along the first portion. The first portion extends from one end thereof and passes through the fastening part, and the other end of the first portion is connected to the second portion. The second portion includes one end extending from the first portion, and the other end coupled with the fastening part. The fastening part includes a cover including a magnet, and a fastening part lower member. In a first state, the magnet is spaced apart from the first portion, and the fastening part is slidable from the first portion. In a second state, the first portion is in contact with the magnet, and the fastening part is fixed to the first portion.

20 Claims, 10 Drawing Sheets

(56) References Cited

U.S. PATENT DOCUMENTS

| | | | | | |
|---|---|---|---|---|---|
| 1,753,207 | A | * | 9/1930 | Kreisler | A44C 5/22 24/323 |
| 1,783,306 | A | * | 12/1930 | Otten | A44C 5/22 24/191 |
| 1,850,722 | A | * | 3/1932 | Kestenman | A44C 5/22 24/191 |
| 4,958,334 | A | | 9/1990 | Grosjean | |
| 5,701,640 | A | | 12/1997 | Locher | |
| 2016/0037897 | A1 | | 2/2016 | Bataillou et al. | |
| 2017/0086538 | A1 | | 3/2017 | Siahaan | |
| 2017/0135449 | A1 | | 5/2017 | Zhang et al. | |
| 2018/0049492 | A1 | | 2/2018 | Dey et al. | |
| 2019/0029373 | A1 | | 1/2019 | Shaffer et al. | |
| 2020/0093688 | A1 | | 3/2020 | Pantaleo | |
| 2020/0268112 | A1 | | 8/2020 | Provencher | |
| 2020/0405015 | A1 | | 12/2020 | Tan | |
| 2021/0267325 | A1 | | 9/2021 | Moustafa et al. | |
| 2021/0373500 | A1 | | 12/2021 | Modaragamage | |

FOREIGN PATENT DOCUMENTS

| | | | |
|---|---|---|---|
| CN | 213045705 | U | 4/2021 |
| JP | 2020528794 | A | 10/2020 |
| KR | 200365972 | Y1 | 10/2004 |
| KR | 101633418 | B1 | 6/2016 |

* cited by examiner

WEARING MEMBER AND WEARABLE DEVICE INCLUDING THE SAME

CROSS-REFERENCE TO RELATED APPLICATIONS

This application is a continuation of International Application No. PCT/KR2023/001188 designating the United States, filed on Jan. 26, 2023, in the Korean Intellectual Property Receiving Office and claiming priority to Korean Patent Application No. 10-2022-0012745, filed on Jan. 27, 2022, in the Korean Intellectual Property Office, the disclosures of all of which are incorporated by reference herein in their entireties.

BACKGROUND

1. Field

Various embodiments of the disclosure relate to a device, for example, a wearing member and a wearable device including the same.

2. Description of Related Art

Typically, an electronic device refers to a device that performs a specified function according to a loaded program, such as a home appliance, an electronic notebook, a portable multimedia player, a mobile communication terminal, a tablet personal computer (PC), a video/audio device, a desktop/laptop computer, and/or an in-vehicle navigation device. As the integration level of electronic devices increases, and high-speed and large-capacity wireless communication becomes common, a single small-sized electronic device such as a mobile communication terminal may be equipped with various functions. For example, an entertainment function such as games, a multimedia function such as music/video playback, a communication and security function for mobile banking, scheduling, and an electronic wallet function as well as a communication function are integrated into one electronic device.

Wearable devices that can be worn on the body have been commercialized, and mobile communication terminals and wearable devices are used routinely. Since a wearable device can be in contact with a user's body for a considerable period of time, it may be useful in medical treatment or healthcare. For example, the electronic device may detect biometric information such as a user's photoplethysmograph (PPG), sleep period, skin temperature, heart rate, or electrocardiogram. The detected biometric information may be stored in the electronic device or transmitted to a medical institution in real time for use in the user's healthcare. Compared to a general electronic device formed in the shape of a bar, a box, or a flat plate, a wearable device may have a plurality of segments combined with each other in consideration of wearing convenience while conforming to a user's body curves. For example, a wrist wearable electronic device may include a housing serving as a main body for accommodating various circuit devices therein, and at least one wearing member, and a face wearable electronic device may include lens(s) corresponding to both eyes of a user and at least one leg (temple bow(s)).

The above information is presented as background information only to assist with an understanding of the present disclosure. No determination has been made, and no assertion is made, as to whether any of the above might be applicable as prior art with regard to the disclosure.

SUMMARY

Technical Problem

Although a progress has been made so considerably that a wearable device is carried or used while worn on the body, user demands for wearable devices with enhanced wearability and a reduced weight are further increasing. Further, as the wearable device is carried or used while worn on the body, there is an increasing user demand for the usefulness of the wearable device as an accessory representing the user's personality in addition to the functions and performance of the wearable device.

Technical Solution

Various embodiments of the disclosure may provide a wearable device which is suitably wearable on various users' bodies, while facilitating attachment and detachment of a wearing member.

The aspects to be achieved in the disclosure are not limited to what has been described above, and additional aspects according to various embodiments may be presented from the following detailed description of the disclosure, partially clear from the description, or understood from the provided embodiments.

According to various embodiments of the disclosure, a wearable device includes: a body including a display assembly, and first and second fixing portions disposed at opposite ends of the display assembly to oppose to each other; a strap part including a first portion and a second portion extending from the first portion; and a fastening part slidable along the first portion. The first portion includes one end coupled with the first fixing portion, extending, and passing through the fastening part, and the other end passing through the second fixing portion, and the second portion includes one end extending from the other end of the first portion and coupled with the second fixing portion, and the other end coupled with the fastening part. The fastening part includes a cover including a magnet, and a fastening part lower member. The cover is configured to provide a first state and a second state. In the first state the magnet of the cover is spaced apart from the first portion, and the fastening part is slidable from the first portion, and in the second state the first portion is in contact with the magnet and the fastening part lower member, and the fastening part is fixed to the first portion.

According to various embodiments of the disclosure, a wearing member includes: a strap part including a first portion and a second portion extending from the first portion; and a fastening part slidable along the first portion. The first portion extends from one end thereof and passes through the fastening part, and the other end of the first portion is connected to the second portion. The second portion includes one end extending from the first portion, and the other end coupled with the fastening part. The fastening part includes a cover including a magnet, and a fastening part lower member. The cover may be configured to provide a first state and a second state. In the first state the magnet is spaced apart from the first portion, and the fastening part is slidable from the first portion, and in the second state the first portion is in contact with the magnet and the fastening part lower member, and the fastening part is fixed to the first portion.

Advantageous Effects

According to various embodiments of the disclosure, a wearable device may be stably fixed to various users' bodies through a wearing member. For example, as the wearing member is coupled with a housing, while its length is continuously varying, the wearable device may be stably worn on various users' bodies.

Other aspects, advantages, and main configurations according to various embodiments of the disclosure may become more apparent to those skilled in the art from the following detailed description given in conjunction with the accompanying drawings.

DETAILED DESCRIPTION

Figure 1:
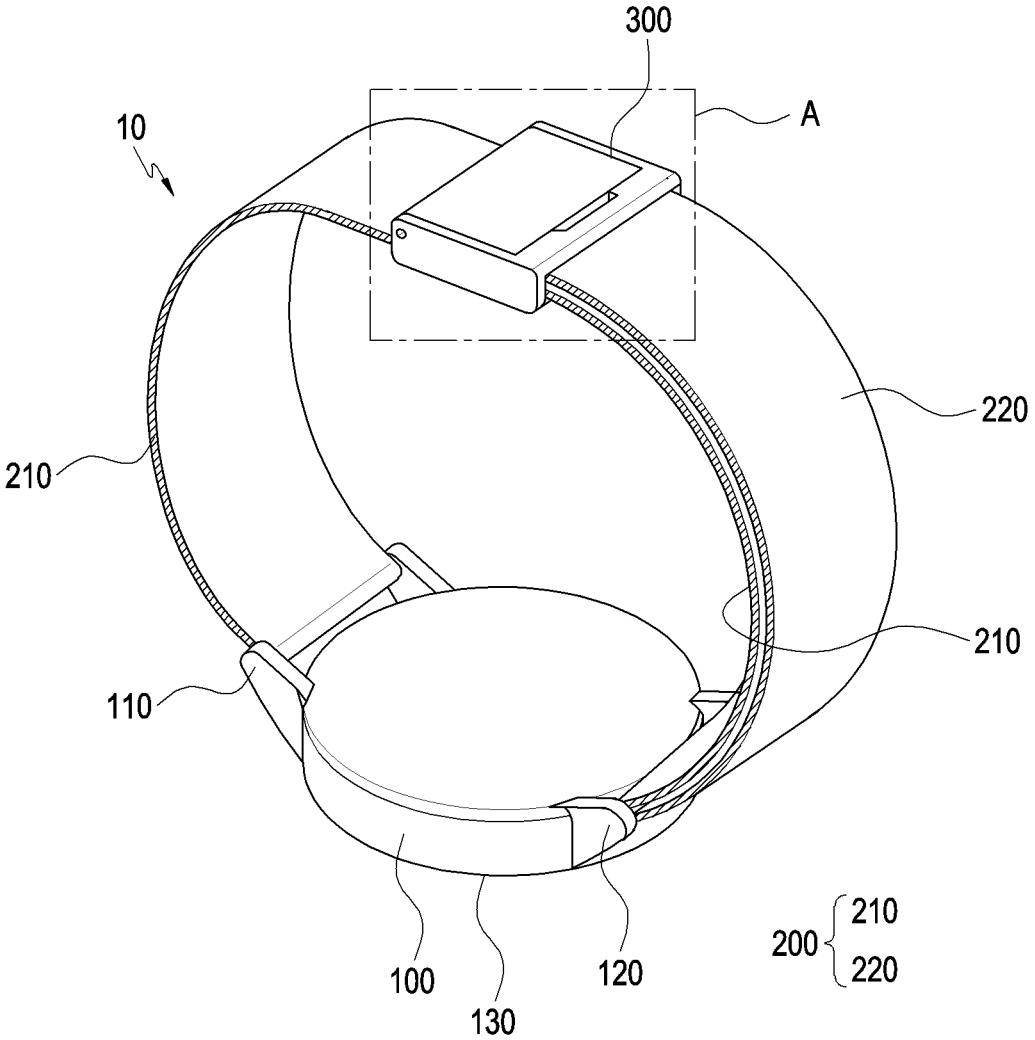
FIG. 1 is a perspective view illustrating a wearable device according to various embodiments.

The following description of the appended drawings may be provided to help a comprehensive understanding of various implementations of the disclosure as defined by the claims and their equivalents. Although a specific embodiment disclosed in the following description includes various specific details to aid understanding, it is considered to be one of various embodiments. Accordingly, it will be apparent to those skilled in the art that various changes and modifications can be made to various implementations of the disclosure without departing from the scope and spirit of the disclosure. For clarity and brevity, a description of well-known functions and configurations may be avoided.

The terms and words used in the following description and claims may be used to clearly and consistently describe various embodiments of the disclosure, not limited to their bibliographical meanings. Therefore, it will be obvious to those skilled in the art that the following description of various implementations of the disclosure is provided only for illustrative purposes, not for the purpose of limiting the disclosure as defined by the claims and their equivalents.

It should be understood that singular forms such as "a", "an", and "the" include plural referents, unless the context clearly dictates otherwise. Thus, for example, reference to "a component surface" may mean including one or more of component surfaces. "At least one" is not to be construed as limiting "a" or "an." "Or" means "and/or." As used herein, the term "and/or" includes any and all combinations of one or more of the associated listed items. As used herein, the term "A/B" means "A and/or B."

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B", "at least one of A and B", "at least one of A or B", "A, B, or C", "at least one of A, B, and C", and "at least one of A, B, or C", may include any one of, or all possible combinations of the items enumerated together in a corresponding one of the phrases. As used herein, such terms as "1st" and "2nd", or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used in connection with various embodiments of the disclosure, the term "module" may include a unit implemented in hardware, software, or firmware, and may interchangeably be used with other terms, for example, logic, logic block, part, or circuitry. A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., a program) including one or more instructions that are stored in a storage medium (e.g., internal memory or external memory) that is readable by a machine (e.g., an electronic device). For example, a processor (e.g., a processor) of the machine (e.g., the electronic device) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities, and some of the multiple entities may be separately disposed in different components. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

FIG. 1 is a perspective view illustrating a wearable device according to various embodiments.

According to various embodiments, a wearable device 10 may include a body 100, a strap part 200, and a fastening part 300. The strap part 200 and the fastening part 300 may be collectively referred to as a "wearing member".

According to various embodiments, the body 100 may have various shapes such as a circle, an oval, or a polygon. The body 100 may include a first fixing portion 110, a second fixing portion 120, and a display assembly 130.

According to various embodiments, the first fixing portion 110 and the second fixing portion 120 may be included in the body 100. The first fixing portion 110 and the second fixing portion 120 may be disposed at opposite ends of the body 100. According to an embodiment, the first fixing portion 110 and the second fixing portion 120 may be disposed at opposite ends of the body 100 to face each other. The strap part 200 may be fixed to the first fixing portion 110 and the second fixing portion 120.

According to various embodiments, the display assembly 130 may be included in the body 100. The display assembly 130 may be disposed in the main body 100 to be visually exposed to a user. A screen output from the display assembly 130 may be in various shapes such as a circle, an oval, or a polygon. The display assembly 130 may be coupled with or disposed adjacent to a touch sensing circuit, a pressure sensor capable of measuring the intensity (pressure) of a touch, and/or a fingerprint sensor. The display assembly 130 may include a display (not shown) recognizable to a user.

According to various embodiments, the strap part 200 may be configured to be connected to the body 100. According to an embodiment, at least part of the strap part 200 may be connected to the body 100. At least part of the strap part 200 may be connected to be fixed to the first fixing portion 110 and the second fixing portion 120 of the body 100. The strap part 200 may include a first portion 210 and a second portion 220. According to an embodiment, the first portion 210 is a part of the strap part 200 and may be defined as a part connected to the first fixing portion 110 and the second fixing portion 120. The first portion 210 may pass through at least part of the fastening part 300. According to an embodiment, the second portion 220 is another part of the strap part 200 and may be defined as a part connected to the second fixing portion 120 and the fastening part 300. According to another embodiment, the first portion 210 is a part of the strap part 200, and may be fixed to the first fixing portion 110 and pass through the second fixing portion 120. The second portion 220, which is another part of the strap part 200, may be a part fixed to the fastening part 300 and extending from a part of the first portion 210 passing through the second fixing portion 120. The strap part 200 may include or be formed of various materials including a metal or a non-metal.

According to various embodiments, the lengths of the first portion 210 and the second portion 220 may vary but, the sum of the length of the of the first portion 210 and the length of the of the second portion 220 may be constant. According to an embodiment, when the fastening part 300 is disposed adjacent to the first fixing portion 110, the length of the first portion 210 may be decreased, and the length of the second portion 220 may be increased. According to another embodiment, when the fastening part 300 is disposed adjacent to the second fixing portion 120, the length of the first portion 210 may be increased, and the length of the second portion 220 may be decreased. As described above, as the lengths of the first portion 210 and the second portion 220 are changed by the movement of the fastening part 300, the size of a cross-section of a region surrounded by the body 100 and the strap part 200 may be continuously changed. As the size of the cross-section of the region surrounded by the body 100 and the strap part 200 is continuously changed, the user may conveniently wear the wearable device 10 according to the user's body shape (e.g., wrist).

Figure 2A:
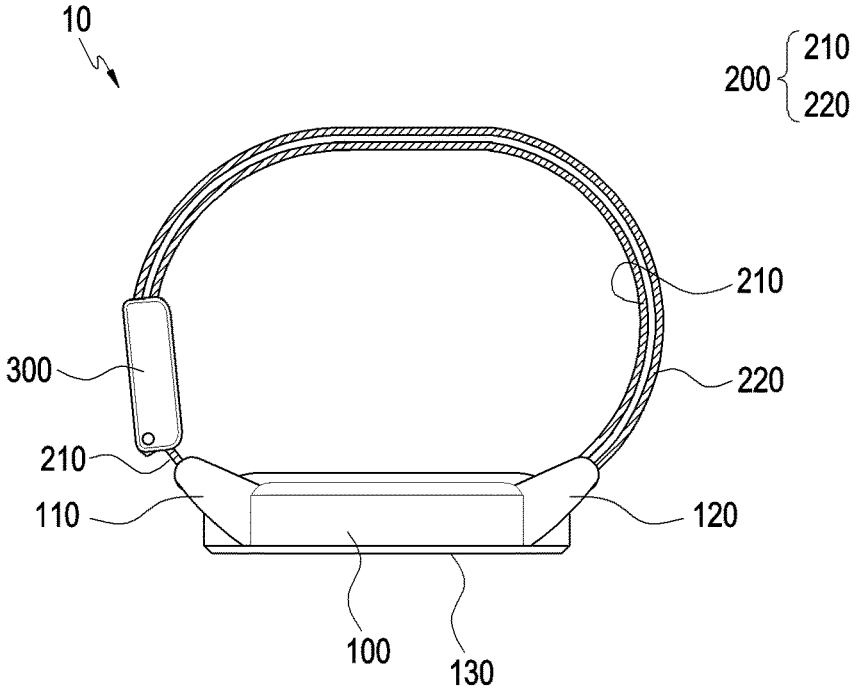
FIG. 2A is a side view illustrating a strap part contracted in the wearable device according to various embodiments.
Figure 2B:
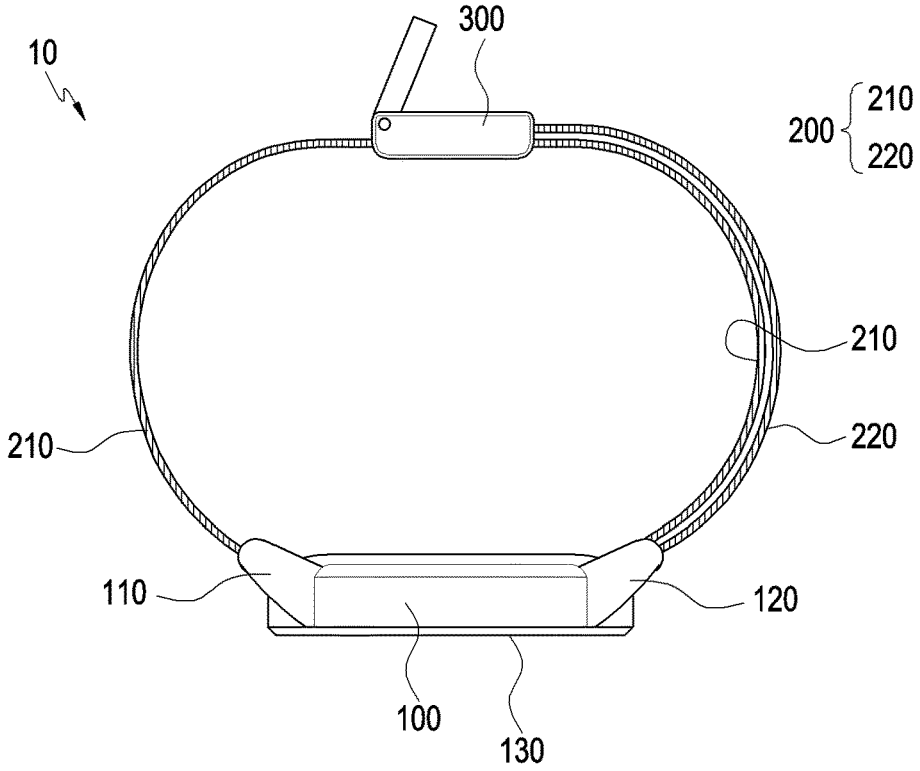
FIG. 2B is a side view illustrating the strap part moderately contracted/extended in the wearable device according to various embodiments.
Figure 2C:
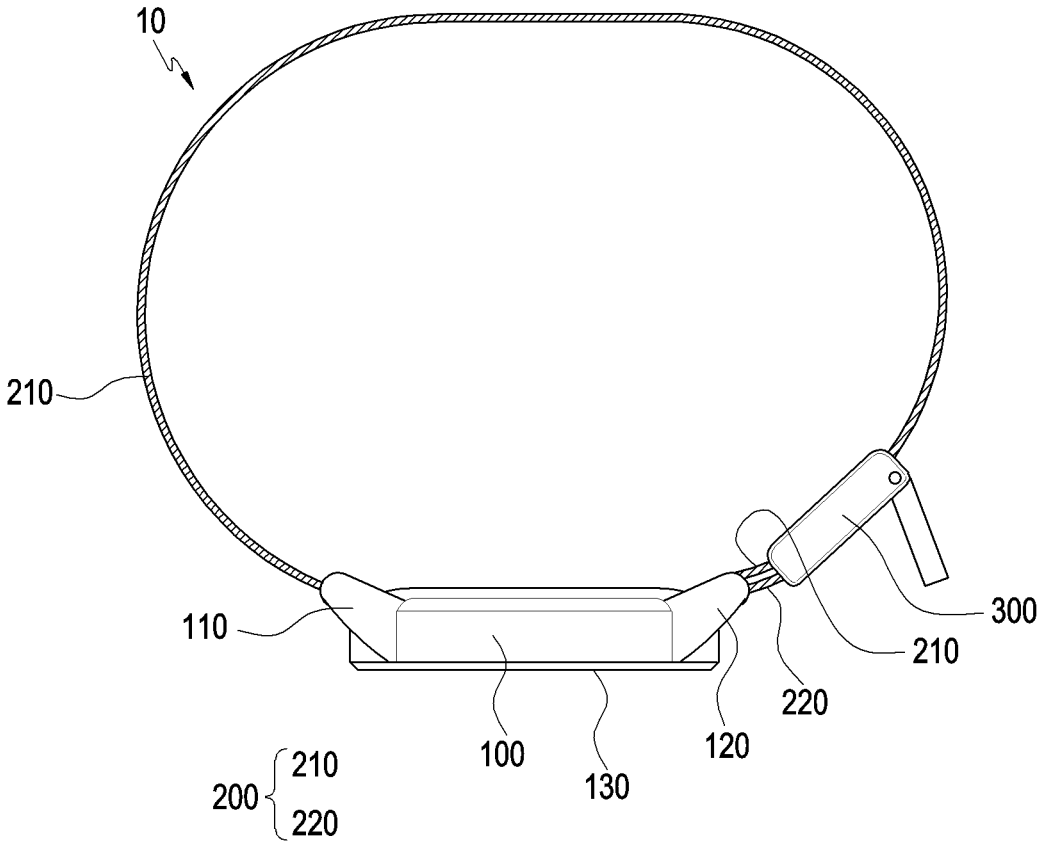
FIG. 2C is a side view illustrating the strap part fully extended in the wearable device according to various embodiments.

FIG. 2A is a side view illustrating the strap part of the wearable device, which has been contracted according to various embodiments, FIG. 2B is a side view illustrating the strap part of the wearable device, which has been moderately contracted/extended according to various embodiments, and FIG. 2C is a side view illustrating the strap part of the wearable device, which has been fully extended according to various embodiments. These side views of FIGS. 2A to 2C are views in a latitudinal direction (named as "Y-axis direction") of the first portion 210 (See FIG. 3A).

The wearable device 10, the body 100, the first fixing portion 110, the second fixing portion 120, the display assembly 130, the strap part 200, the first portion 210, the second portion 220, and the fastening part 300 illustrated in FIGS. 2A, 2B and 2C may be identical or similar to the wearable device 10, the body 100, the first fixing portion 110, the second fixing portion 120, the display assembly 130, the strap part 200, the first portion 210, the second portion 220, and the fastening part 300 illustrated in FIG. 1. Accordingly, a description of the same components may be omitted.

Figure 3A:
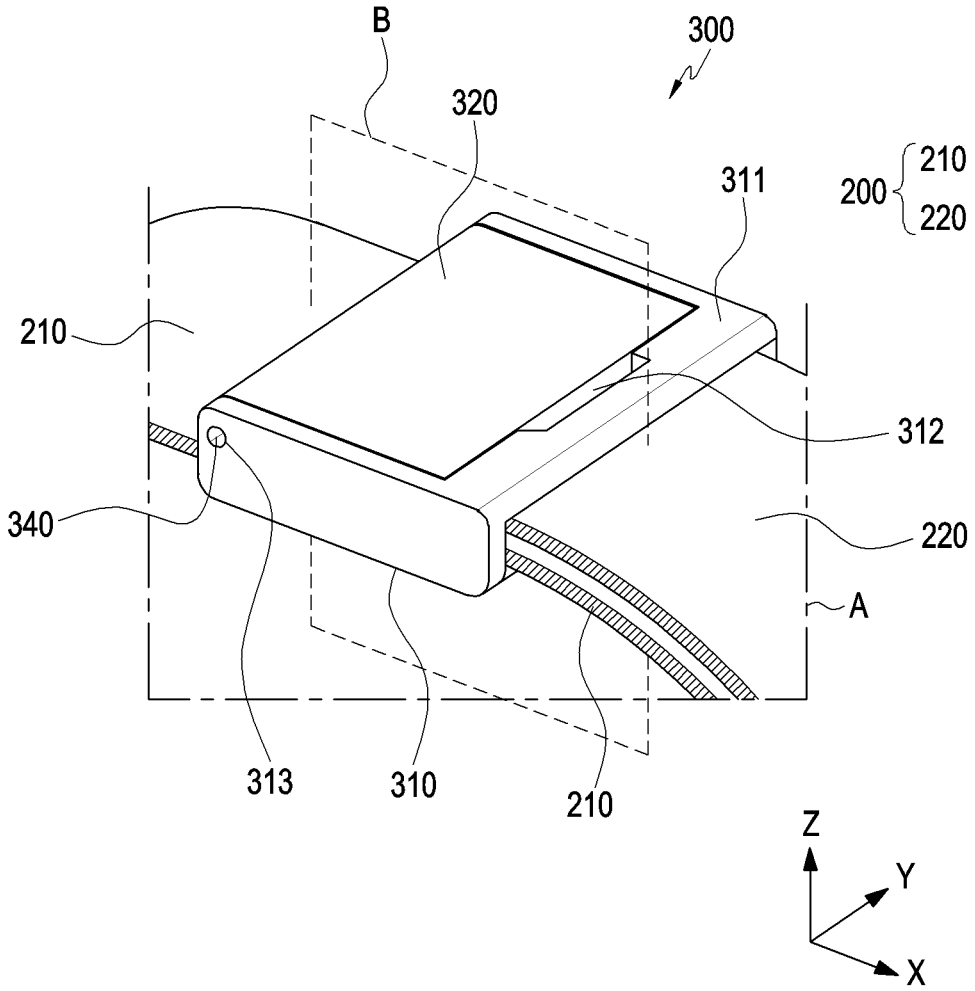
FIG. 3A is an enlarged perspective view illustrating the strap part and a fastening part in a fixed state in the wearable device according to various embodiments.

According to various embodiments, the fastening part 300 may slide along a longitudinal direction (named as "X-axis direction") of the first portion 210 (See FIG. 3A).

Referring to FIG. 2A, according to various embodiments, the fastening part 300 may be disposed adjacent to the first fixing portion 110 by sliding along the longitudinal direction (X-axis direction) of the first portion 210. As the fastening part 300 is disposed adjacent to the first fixing portion 110, the length of the first portion 210 may be shortest, and the length of the second portion 220 may be longest. Accordingly, the size of the cross-section of the region surrounded by the body 100 and the strap part 200 may be reduced.

Referring to FIG. 2B, according to various embodiments, the fastening part 300 may be disposed between the first fixing portion 110 and the second fixing portion 120 by sliding along the longitudinal direction (X-axis direction) of the first portion 210. Compared to FIG. 2A, as the fastening part 300 is disposed between the first fixing portion 110 and the second fixing portion 120 as illustrated in FIG. 2B, the length of the first portion 210 may be increased, and the length of the second portion 220 may be decreased. Accordingly, the size of the cross-section of the region surrounded by the body 100 and the strap part 200 may increase.

Referring to FIG. 2C, according to various embodiments, the fastening part 300 may be disposed adjacent to the second fixing portion 120 by sliding along the longitudinal direction (X-axis direction) of the first portion 210. Compared to FIGS. 2A and 2B, as the fastening part 300 is disposed adjacent to the second fixing portion 120 as illustrated in FIG. 2C, the length of the first portion 210 may be longest, and the length of the second portion 220 may be shortest.

As described above, the lengths of the first portion 210 and the second portion 220 of the strap part 200 change according to the movement of the fastening part 300, so that the size of the cross-section of the region surrounded by the body 100 and the strap part 200 may increase or decrease. As the size of the cross-section of the region surrounded by the body 100 and the strap part 200 increases or decreases, the user may conveniently wear the wearable device 10.

Figure 3B:
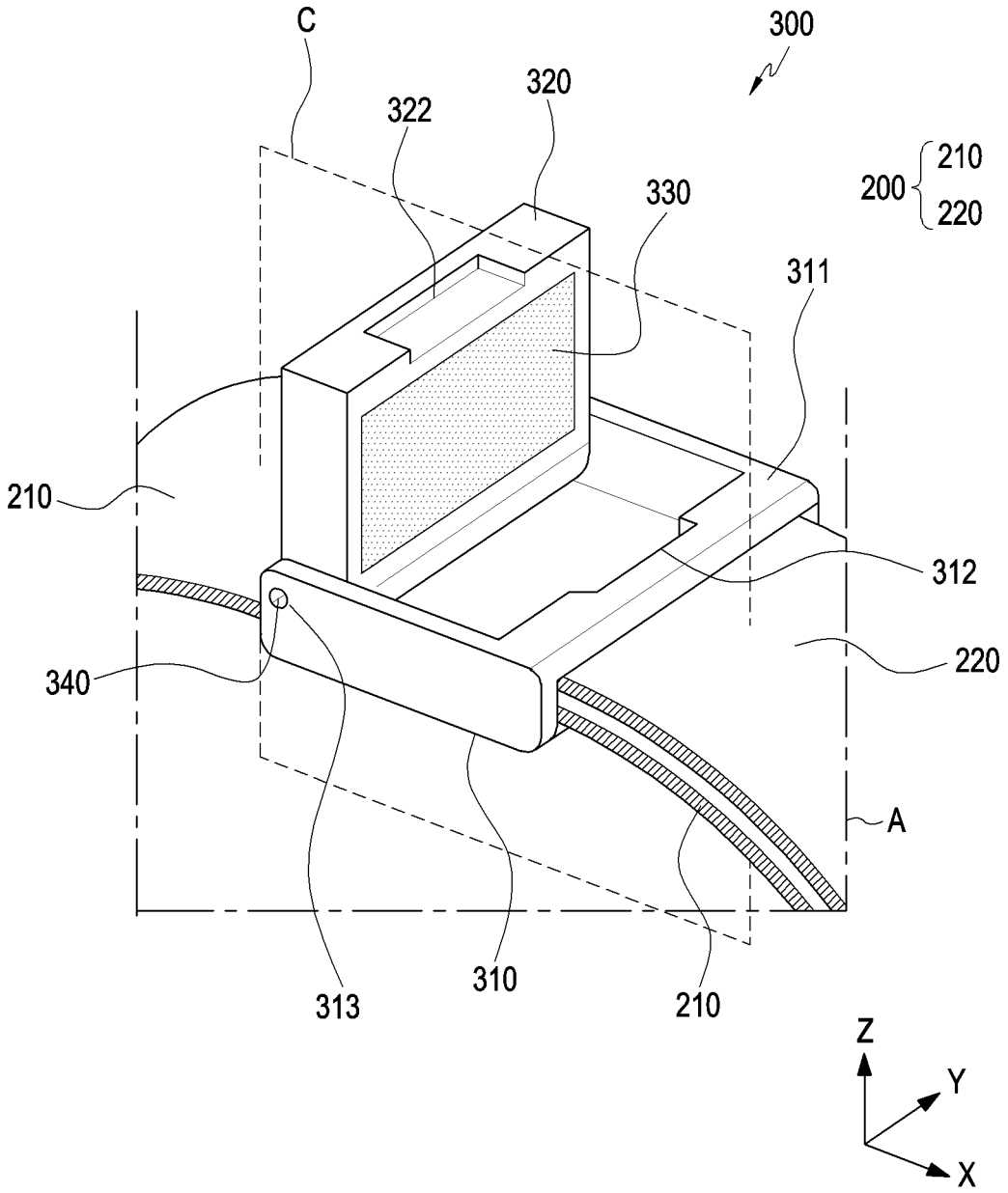
FIG. 3B is an enlarged perspective view illustrating the strap part and the fastening part in a non-fixed state in the wearable device according to various embodiments.

FIG. 3A is an enlarged perspective view illustrating the strap part and the fastening part in a fixed state in the wearable device according to various embodiments, and FIG. 3B is an enlarged perspective view illustrating the strap part and the fastening part in a non-fixed state in the wearable device according to various embodiments.

The strap part 200, the first portion 210, the second portion 220, and the fastening part 300 illustrated in FIGS. 3A and 3B may be identical or similar to the strap part 200, the first portion 210, the second portion 220, and the fastening part 300 illustrated in FIGS. 1 to 2C. Accordingly, a description of the same components may be omitted. The strap part 200 and the fastening part 300 may be collectively referred to as a "wearing member". FIGS. 3A and 3B are enlarged views of a first region A illustrated in FIG. 1.

FIG. 3A illustrates the fastening part 300 in the fixed state. A cover 320 of the fastening part 300 in the fixed state may be disposed in parallel with at least part of the first portion 210 adjacent to the fastening part 300.

Referring to FIG. 3A, according to various embodiments, the first portion 210 of the strap part 200 may pass through the fastening part 300, and the second portion 220 may be fixed to the fastening part 300.

According to various embodiments, the fastening part 300 may include a fastening part lower member 310, a fastening part upper member 311, a fastening part opening/closing groove 312, a fastening part hole 313, a fastening part fitting groove 314, the cover 320, a cover hole 321, a cover opening/closing groove 322, a magnet 330, and a pin 340. The fastening part 300 may include or be formed of a metal and/or a non-metal, and at least part of the fastening part 300 may include or be formed of a metal.

According to various embodiments, the fastening part lower member 310 may be disposed in a lower part of the fastening part 300 in a height direction (named as "Z-axis direction") of the fastening part 300. The fastening part lower member 310 may be disposed in the lower part of the fastening part 300 to come into contact with part of the user's body. The fastening part lower member 310 may include or be formed of a metal and/or a non-metal. According to an embodiment, at least part of the fastening part lower member 310 may include or be formed of a metal.

According to various embodiments, the fastening part upper member 311 may be disposed in an upper part of the fastening part 300 in the height direction (Z-axis direction) of the fastening part 300. The fastening part upper member 311 may be disposed to be spaced upward apart from the fastening part lower member 310 in the height direction (Z-axis direction) of the fastening part 300. The first portion 210 of the strap part 200 may be disposed in a separation space between the fastening part lower member 310 and the fastening part upper member 311. The first portion 210 may pass through the separation space between the fastening part lower member 310 and the fastening part upper member 311. As the first portion 210 passes through the separation space between the fastening part lower member 310 and the fastening part upper member 311, the fastening part 300 may slide along the longitudinal direction (X-axis direction) of the first portion 210 of the strap part 200. The fastening part opening/closing groove 312 may be defined on the fastening part upper member 311. The fastening part opening/closing groove 312 may be formed on the fastening part upper member 311.

According to various embodiments, the fastening part opening/closing groove 312 may be defined on the fastening part upper member 311. The fastening part opening/closing groove 312 may correspond to a gap between the cover 320 and the fastening part upper member 311. As the fastening part opening/closing groove 312 is formed on an outer surface of the fastening part upper member 311, the user may easily open or close the cover 320. According to an embodiment, the fastening part opening/closing groove 312 may be defined as a groove recessed from at least a portion of the fastening part upper member 311.

According to various embodiments, the fastening part hole 313 may be defined in the fastening part 300. According to an embodiment, the fastening part hole 313 may be defined in a side surface of the fastening part 300. At least two fastening part holes 313 may be defined in opposite sides of the fastening part 300 in the latitudinal direction (Y-axis direction). The pin 340 may be fixedly inserted into the fastening part hole 313. The pin 340 may be fixed in the fastening part hole 313 and disposed to pass through at least part of the cover 320. As the pin 340 penetrates the at least part of the cover 320, the cover 320 may rotate about the pin 340 as an axis. According to an embodiment, the fastening part hole 313 may be defined as a hole penetrated from at least a portion of the sides of the fastening part 300.

FIG. 3B illustrates the fastening part 300 in the non-fixed state. The cover 320 of the fastening part 300 in the non-fixed state may be disposed to form an angle with the first portion 210 adjacent to the fastening part 300.

According to various embodiments, the cover hole 321 may be defined in the cover 320. The cover hole 321 may be defined at a position of a part of the cover 320 corresponding to the fastening part hole 313. According to an embodiment, the cover hole 321 may be defined as a hole penetrated from at least a portion of the cover 320 corresponding to the fastening part hole 313. The pin 340 may be disposed to pass through the cover hole 321. The magnet 330 may be disposed between the cover 320 and the fastening part lower member 310. According to an embodiment, a groove may be defined on one surface of the cover 320 facing the fastening part lower member 310 of the fastening part 300, so that the magnet 330 may be disposed in the groove. According to an embodiment, the groove may be defined as a groove recessed on one surface of the cover 320 facing the fastening part lower member 310 of the fastening part 300, the magnet 330 may be disposed in the groove. The magnet 330 may generate an attractive force through a magnetic force with the fastening part lower member 310. Accordingly, the attractive force may be generated between the cover 320 and the fastening part lower member 310. As the attractive force is generated between the cover 320 and the fastening part lower member 310, a frictional force may be generated in the first portion 210 passing through the fastening part 300 in the fixed state, thereby fixing the fastening part 300 to the first portion 210.

According to various embodiments, the cover opening/closing groove 322 may be defined or formed on a side surface of the cover 320. The cover opening/closing groove 322 may be defined or formed at a position corresponding to the fastening part opening/closing groove 312 defined or formed on the fastening part upper member 311. As the cover opening/closing groove 322 is defined or formed on the cover 320, a space may be formed between the cover 320 and the fastening part upper member 311. As the space is formed between the cover 320 and the fastening part upper member 311, the user may easily open and close the cover 320.

Figure 4A:
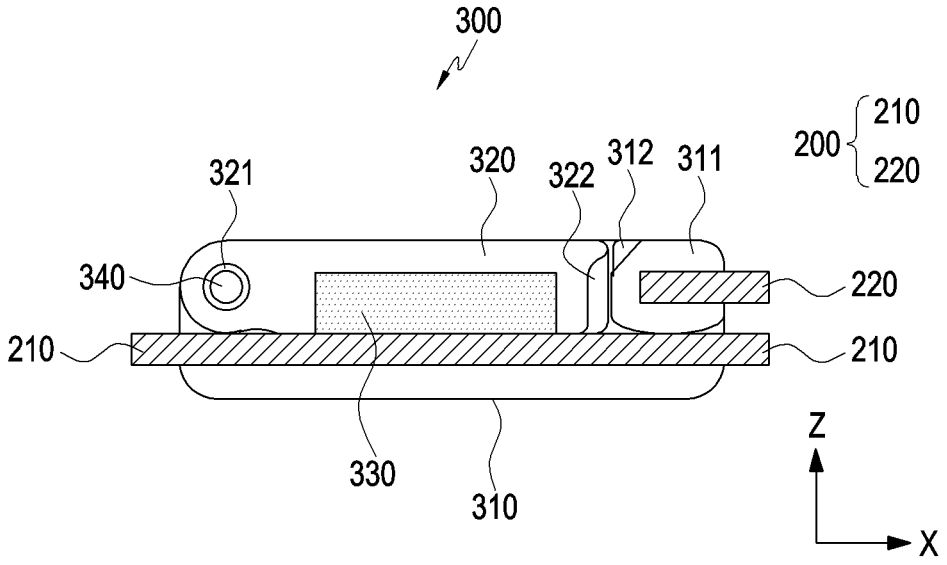
FIG. 4A is a cross-sectional view illustrating the fastening part in the fixed state in the wearable device according to various embodiments, taken along a longitudinal direction of the strap part.
Figure 4B:
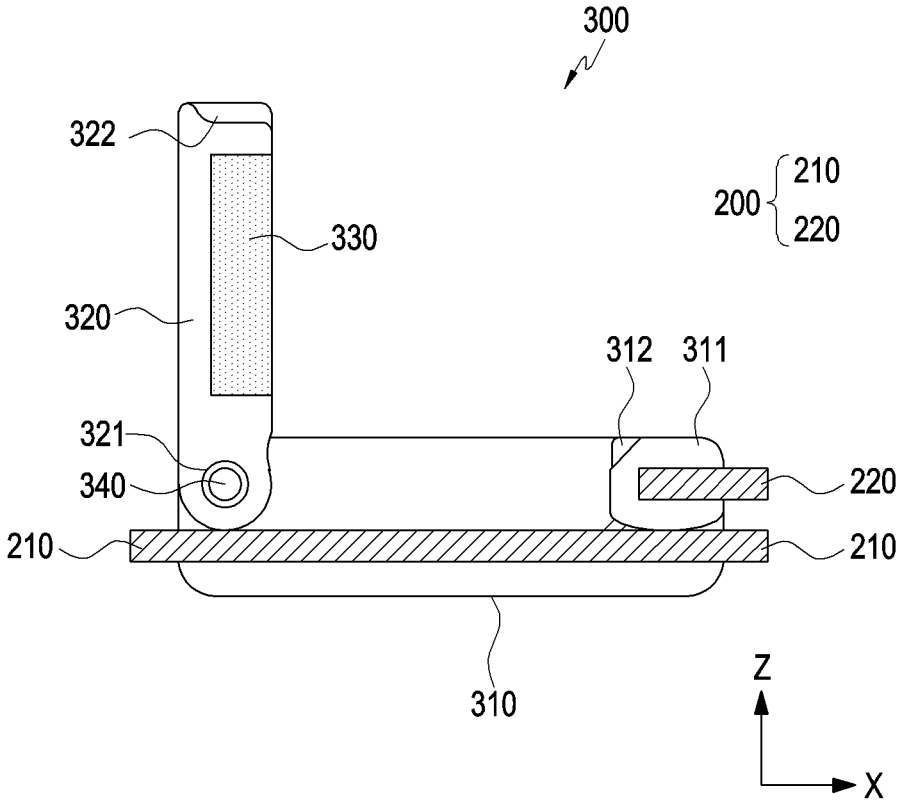
FIG. 4B is a cross-sectional view illustrating the fastening part in the non-fixed state in the wearable device according to various embodiments, taken along the longitudinal direction of the strap part.

FIG. 4A is a cross-sectional view illustrating the fastening part in the fixed state in the wearable device according to various embodiments, taken along the longitudinal direction of the strap part, and FIG. 4B is a cross-sectional view illustrating the fastening part in the non-fixed state in the wearable device according to various embodiments, taken along the longitudinal direction of the strap part. These cross-sectional views of FIGS. 4A to 4B are views in the Y-axis direction.

The strap part 200, the first portion 210, the second portion 220, the fastening part 300, the fastening part lower member 310, the fastening part upper member 311, the fastening part opening/closing groove 312, the cover 320, the cover hole 321, the cover opening/closing groove 322, and the magnet 330 illustrated in FIGS. 4A and 4B may be identical or similar to the strap part 200, the first portion 210, the second portion 220, the fastening part 300, the fastening part lower member 310, the fastening part upper member 311, the fastening part opening/closing groove 312, the cover 320, the cover hole 321, the cover opening/closing groove 322, and the magnet 330 illustrated in FIGS. 1 to 3B. Accordingly, a description of the same components may be omitted. The strap part 200 and the fastening part 300 may be collectively referred to as a "wearing member".

FIG. 4A illustrates a cross-section of the strap part 200 and the fastening part 300 in the fixed state illustrated in FIG. 3A, cut along a first plane B defined by the X-axis direction and the Z-axis direction. FIG. 4B illustrates a cross-section of the strap part 200 and the fastening part 300 in the non-fixed state illustrated in FIG. 3B, cut along a second plane C defined by the X-axis direction and the Z-axis direction.

Referring to FIG. 4A, according to various embodiments, the first portion 210 of the strap part 200 may pass through the fastening part 300. According to an embodiment, the first portion 210 may be disposed between the cover 320 and the fastening part lower member 310. The first portion 210 may be disposed between the fastening part upper member 311 and the fastening part lower member 310. The magnet 330 and the fastening part lower member 310 disposed on the cover 320 may generate an attractive force through a magnetic force. The cover 320 and/or the magnet 330 may come into contact with the first portion 210 to cause friction. The fastening part lower member 310 may come into contact with the first portion 210 to cause friction. The first portion 210 may come into contact with the fastening part lower member 310, the cover 320, and/or the magnet 330 to cause friction, and thus the fastening part 300 may be fixed at a predetermined position or a specific position of the first portion 210 in the fixed state.

According to various embodiments, the cover hole 321 may be defined or formed in part of the cover 320. The cover hole 321 may penetrate the cover 320. The cover hole 321 may be defined or formed at a position corresponding to the fastening part hole (e.g., the fastening part hole 313 of FIG. 3A) of the fastening part 300. The pin 340 may be disposed in the cover hole 321. As the pin 340 passes through the cover hole 321 and is fixed in the fastening part hole 313, the cover 320 may rotate about the pin 340 as an axis.

According to various embodiments, the second portion 220 of the strap part 200 may be fixedly coupled with the fastening part 300. According to an embodiment, at least part of the second portion 220 may be fitted in at least part of the fastening part 300.

Referring to FIG. 4B, according to various embodiments, the cover 320 may rotate about the pin 340 as an axis. According to an embodiment, the cover 320 or a major surface of the cover 320 may be disposed perpendicularly to the first portion 210. As the cover 320 and the first portion 210 are disposed perpendicularly to each other, the magnet 330 and the first portion 210 do not come into contact with each other, thereby causing no friction. As the cover 320 (especially, the major surface thereof) and the first portion 210 are disposed perpendicularly to each other, the cover 320 and the first portion 210 may not contact or may contact over a reduced area, and thus reduced friction or no friction may be generated. Accordingly, the fastening part 300 may slide along the first portion 210 in the non-fixed state. As the fastening part 300 moves along the first portion 210, the size of the region surrounded by the strap part 200 and the body (e.g., the body 100 of FIG. 1) may change, so that the user may wear the wearable device (e.g., the wearable device 10 of FIG. 1) comfortably.

Figure 5:
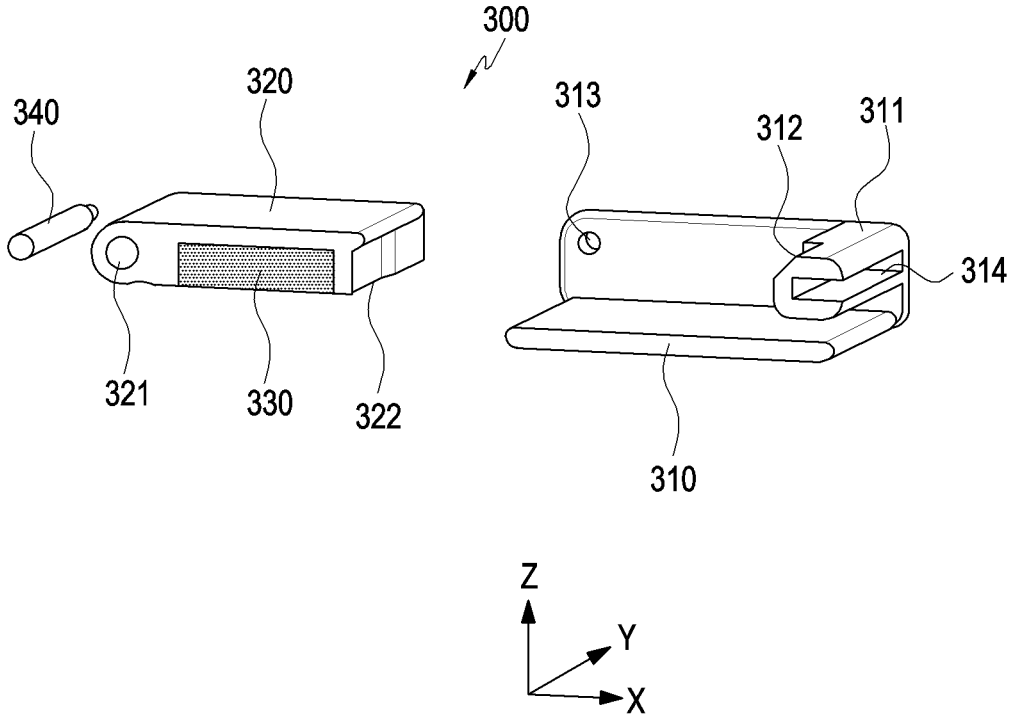
FIG. 5 is an exploded perspective view illustrating the fastening part in the fixed state illustrated in FIG. 4A according to various embodiments.

FIG. 5 is an exploded perspective view illustrating the fastening part in the fixed state illustrated in FIG. 4A according to various embodiments.

The fastening part 300, the fastening part lower member 310, the fastening part upper member 311, the fastening part opening/closing groove 312, the fastening part hole 313, the cover 320, and the cover hole 321, the cover opening/closing groove 322, the magnet 330, and the pin 340 illustrated in FIG. 5 may be identical or similar to the fastening part 300, the fastening part lower member 310, the fastening part upper member 311, the fastening part opening/closing groove 312, the fastening part hole 313, the cover 320, and the cover hole 321, the cover opening/closing groove 322, the magnet 330, and the pin 340 illustrated in FIGS. 1 to 4. Accordingly, a description of the same components may be omitted. The strap part 200 and the fastening part 300 may be collectively referred to as a "wearing member".

Referring to FIG. 5, according to various embodiments, the fastening part fitting groove 314 may be defined or formed in the fastening part 300. According to an embodiment, the fastening part fitting groove 314 may be defined or formed on the fastening part upper member 311 of the fastening part 300. A cross-section of the fastening part fitting groove 314 may be in the shape of a fork as shown in FIG. 5. At least part of the strap part 200 may be fitted into the fastening part fitting groove 314. According to an embodiment, the second portion 220 of the strap part 200 may be fitted into the fastening part fitting groove 314.

According to various embodiments, a step may be formed at an end of the pin 340. A large-diameter portion of the pin 340 may be disposed in the cover hole 321 of the cover 320, and a small-diameter portion of the pin 340 may be fixed in the fastening part hole 313 of the fastening part 300.

Figure 6A:
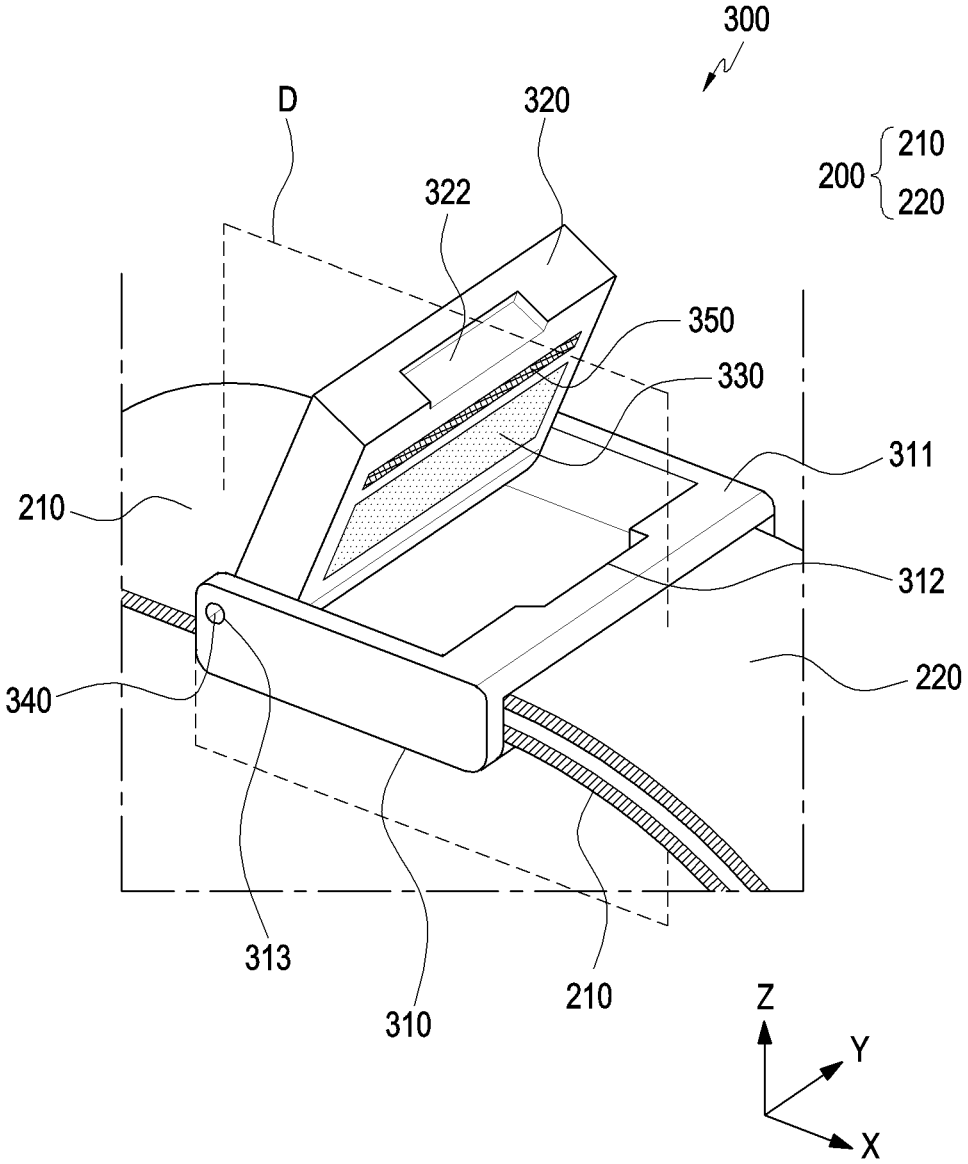
FIG. 6A is a perspective view illustrating the strap part and the fastening part in the non-fixed state in the wearable device according to various embodiments.
Figure 6B:
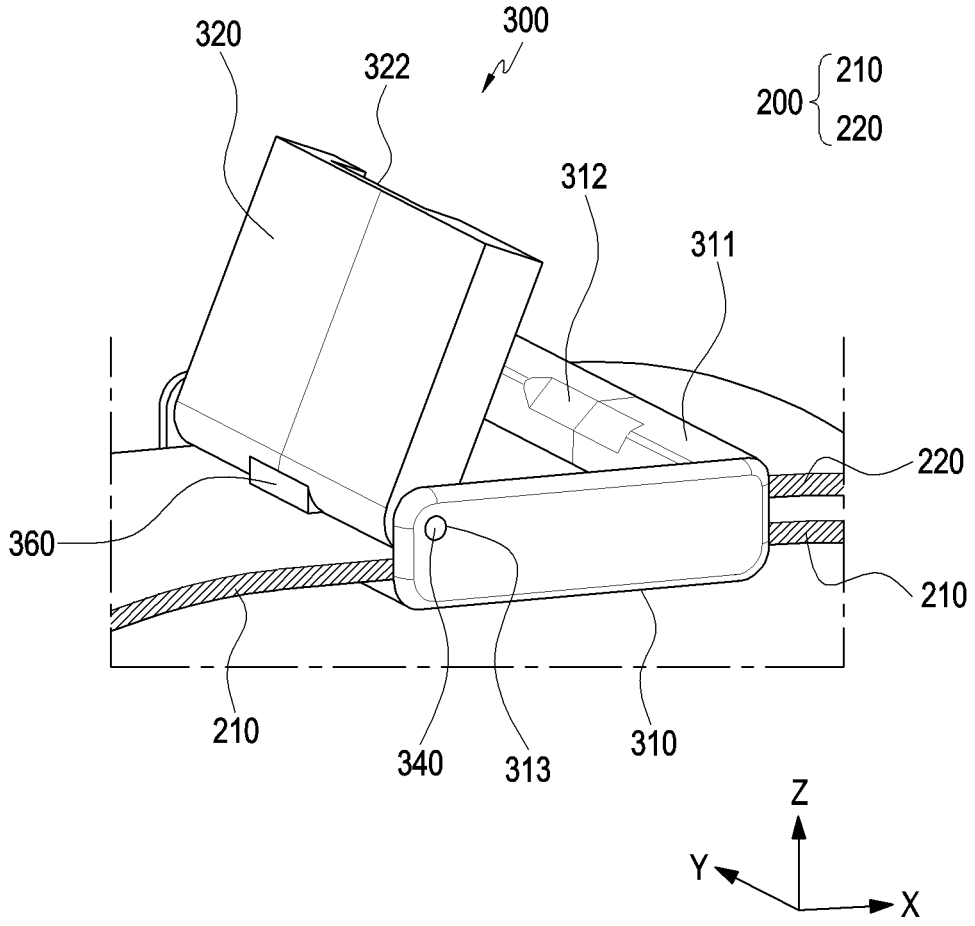
FIG. 6B is a perspective view illustrating the strap part and the fastening part in the non-fixed state in the wearable device according to various embodiments, viewed from another direction.
Figure 6C:
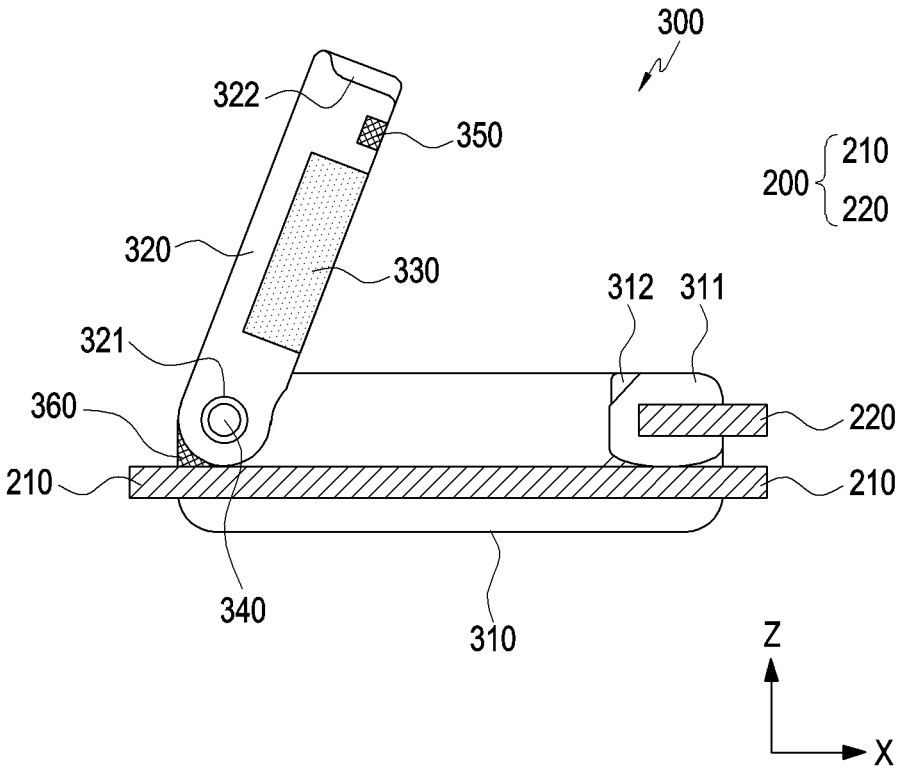
FIG. 6C is a cross-sectional view illustrating the fastening part in the non-fixed state in the wearable device according to various embodiments, taken along the longitudinal direction of the strap part.
Figure 6D:
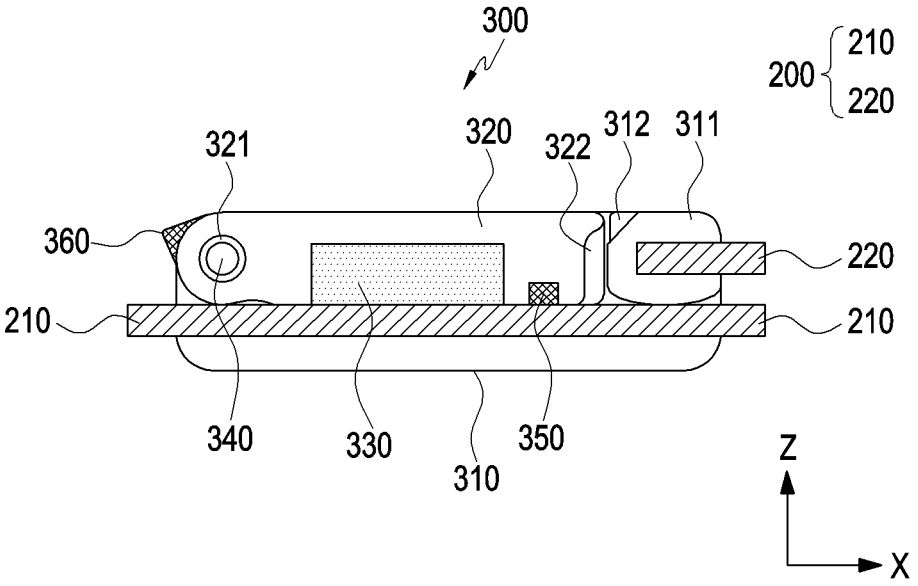
FIG. 6D is a cross-sectional view illustrating the fastening part in the fixed state in the wearable device according to various embodiments, taken along the longitudinal direction of the strap part.

FIG. 6A is a perspective view illustrating the strap part and the fastening part in the non-fixed state in the wearable device according to various embodiments, FIG. 6B is a perspective view illustrating the strap part and the fastening part in the non-fixed state in the wearable device according to various embodiments, viewed from another direction, FIG. 6C is a cross-sectional view illustrating the fastening part in the non-fixed state in the wearable device according to various embodiments, taken along the longitudinal direction of the strap part, and FIG. 6D is a cross-sectional view illustrating the fastening part in the fixed state in the wearable device according to various embodiments, taken along the longitudinal direction of the strap part.

The strap part 200, the first portion 210, the second portion 220, the fastening part 300, the fastening part lower member 310, the fastening part upper member 311, the fastening part opening/closing groove 312, the cover 320, the cover opening/closing groove 322, the magnet 330, and the pin 340 illustrated in FIGS. 6A to 6D may be identical or similar to the strap part 200, the first portion 210, the second portion 220, the fastening part 300, the fastening part lower member 310, the fastening part upper member 311, the fastening part opening/closing groove 312, the cover 320, the cover opening/closing groove 322, the magnet 330, and the pin 340 illustrated in FIGS. 1 to 5. Therefore, a description of the same components may be omitted. The strap part 200 and the fastening part 300 may be collectively referred to as a "wearing member".

According to various embodiments, the fastening part 300 may further include a first friction member 350 and/or a second friction member 360.

Referring to FIGS. 6A to 6D, according to various embodiments, the first friction member 350 may be disposed in the fastening part 300. According to an embodiment, the first friction member 350 may be disposed on a surface of the cover 320 contacting the first portion 210. The first friction member 350 may be disposed between the cover opening/closing groove 322 and the magnet 330. As the first friction member 350 is disposed in the at least part of the cover 320, the first friction member 350 may contact the first portion 210. As the first friction member 350 comes into contact with the first portion 210, friction may further be generated, thereby increasing friction generated between the fastening part 300 and the first portion 210. Accordingly, the coupling force between the fastening part 300 and the first portion 210 in the fixed state may increase.

According to various embodiments, the second friction member 360 may be disposed in the fastening part 300. According to an embodiment, the second friction member 360 may be disposed on at least part of the cover 320. The second friction member 360 may be disposed on part of the fastening part 300 opposite to the cover opening/closing groove 322. The second friction member 360 may be disposed opposite to the cover opening/closing groove 322 with respect to the fastening part hole (e.g., the fastening part hole 313 of FIG. 5). As the second friction member 360 is disposed in part of the cover 320, rotation of the cover 320 may be restricted up to a predetermined angle of the cover 320 with respect to the fastening part lower member 310 or first portion 210. Here, the predetermined angle is more than 0 degree)(° and less than 90 degrees. As the rotation of the cover 320 is restricted, the user's convenience of the wearable device (e.g., the wearable device 10 of FIG. 1) may be increased.

According to various embodiments of the disclosure, a wearable device (e.g., the wearable device 10 of FIG. 1) may include a body (e.g., the body 100 of FIG. 1) including a display assembly (e.g., the display assembly 130 of FIG. 1), and a first fixing portion (e.g., the first fixing portion 110 of FIG. 1) and a second fixing portion (e.g., the second fixing portion 120 of FIG. 1) disposed or formed at opposite ends of the display assembly to oppose to each other; a strap part (e.g., the strap part 200 of FIG. 1) including a first portion (e.g., the first portion 210 of FIG. 1) and a second portion (e.g., the second portion 220 of FIG. 1) extending from the first portion; and a fastening part (e.g., the fastening part 300 of FIG. 1) slidable along at least part of the first portion. The first portion may include one end coupled with the first fixing portion, extending, and passing through the fastening part, and the other end passing through the second fixing portion, and the second portion may include one end extending from the other end of the first portion and coupled with the second fixing portion, and the other end coupled with the fastening part. The fastening part may include a cover (e.g., the cover 320 of FIG. 5) including a magnet (e.g., the magnet 330 of FIG. 5), and a fastening part lower member (e.g., the fastening part lower member 310 of FIG. 5). The cover may be configured to provide a first state and a second state. In the first state the magnet may be spaced apart from the first portion, and the fastening part may be slidable from the first portion, and in the second state the first portion may be in contact with the magnet and the fastening part lower member, and the fastening part may be fixed to the first portion.

According to various embodiments, at least part of the second portion may be disposed to oppose to at least part of the first portion, and relatively slidable with respect to the at least part of the first portion, and the fastening part may be relatively slidable with respect to the first portion.

According to various embodiments, the first portion may pass between the fastening part lower member and the cover.

According to various embodiments, the fastening part may further include a pin. A fastening part hole may be defined in a side surface of the fastening part, a cover hole may be defined in the cover, and the pin may be coupled through the fastening part hole and the cover hole. The cover may be configured to rotate about the pin as an axis with respect to the fastening part lower member.

According to various embodiments, the fastening part may further define a fastening part fitting groove (e.g., the fastening part fitting groove 314 of FIG. 5), and the other end of the second portion may be fixed in the fastening part fitting groove.

According to various embodiments, the cover further includes a first friction member (e.g., the first friction member 350 of FIG. 6C) and a second friction member (e.g., the second friction member 360 of FIG. 6C).

According to various embodiments, the first friction member may restrict movement of the first portion in the first state, and the first portion in the second state may be movable.

According to various embodiments, the second friction member may restrict an angle between the cover and the fastening part lower member in the second state to be equal to or less than a specified value.

According to various embodiments, the fastening part may further include a fastening part upper member over the fastening part lower member, a cover opening/closing groove (e.g., the cover opening/closing groove 322 of FIG. 6C) may be defined on the cover, and a fastening part opening/closing groove (e.g., the fastening part opening/closing groove 312 of FIG. 6C) may be defined on the fastening part upper member.

According to various embodiments, the strap part may be made of at least one of a metal or a non-metal.

According to various embodiments of the disclosure, a wearing member may include: a strap part (e.g., the strap part 200 of FIG. 1) including a first portion (e.g., the first portion 210 of FIG. 1) and a second portion (e.g., the second portion 220 of FIG. 1) extending from the first portion; and a fastening part (e.g., the fastening part 300 of FIG. 1) slidable along at least part of the first portion. The first portion may extend from one end thereof and pass through the fastening part, and the other end of the first portion may be connected to the second portion, the second portion may include one end extending from the first portion, and the other end coupled with the fastening part, the fastening part may include a cover (e.g., the cover 320 of FIG. 5) including a magnet (e.g., the magnet 330 of FIG. 5), and a fastening part lower member (e.g., the fastening part lower member 310 of FIG. 5). The cover may be configured to provide a first state and a second state. In the first state the magnet of the cover may be spaced apart from the first portion, and the fastening part may be slidable from the first portion, and in the second state the first portion may be in contact with the magnet and the fastening part lower member, and the fastening part may be fixed to the first portion.

According to various embodiments, at least part of the second portion may be disposed to oppose to at least part of the first portion, and relatively slidable with respect to the at least part of the first portion, and the fastening part may be relatively slidable with respect to the first portion.

According to various embodiments, the first portion may pass between the fastening part lower member and the cover.

According to various embodiments, the fastening part may further include a pin (e.g., the pin 340 of FIG. 5), a fastening part hole (e.g., the fastening part hole 313 of FIG. 5) may be defined in a side surface of the fastening part, a cover hole (e.g., the cover hole 321 of FIG. 5) may be defined in the cover, the pin may be coupled through the fastening part hole and the cover hole, and the cover may be configured to rotate about the pin as an axis with respect to the fastening part lower member.

According to various embodiments, the fastening part may further define a fastening part fitting groove (e.g., the fastening part fitting groove 314 of FIG. 5), and the other end of the second portion may be fixed in the fastening part fitting groove.

According to various embodiments, the cover may further include a first friction member (e.g., the first friction member 350 of FIG. 6C) and a second friction member (e.g., the second friction member 360 of FIG. 6C).

According to various embodiments, the first friction member may restrict movement of the first portion in the first state, and the first portion in the second state may be movable.

According to various embodiments, the second friction member may restrict an angle between the cover and the fastening part lower member in the second state to be equal to or less than a specified value.

According to various embodiments, the fastening part may further include a fastening part upper member over the fastening part lower member, a cover opening/closing groove (e.g., the cover opening/closing groove 322 of FIG. 6C) may be defined on the cover, and a fastening part opening/closing groove is defined on the fastening part upper member.

According to various embodiments, the strap part may be made of at least one of a metal or a non-metal.

While specific embodiments have been described above in the detailed description of the disclosure, it will be apparent to those skilled in the art that many modifications can be made without departing from the scope of the disclosure.

What is claimed is:

1. A wearable device comprising:

a body including a display assembly, and a first fixing portion and a second fixing portion disposed at opposite ends of the display assembly to oppose to each other;

a strap part including a first portion and a second portion extending from the first portion; and a fastening part slidable along the first portion, wherein the first portion includes one end coupled with the first fixing portion, extending, and passing through the fastening part, and an opposite end passing through the second fixing portion, wherein the second portion includes one end extending from the opposite end of the first portion and coupled with the second fixing portion, and an opposite end coupled with the fastening part, wherein the fastening part includes a cover including a magnet, and a fastening part lower member, wherein the cover is configured to provide a first state and a second state, wherein in the first state the magnet of the cover is spaced apart from the first portion, and the fastening part is slidable along the first portion, and wherein in the second state the first portion is in contact with the magnet and the fastening part lower member, and the fastening part is fixed to the first portion.

2. The wearable device of claim 1, wherein at least part of the second portion is disposed to oppose at least part of the first portion, and is relatively slidable with respect to the at least part of the first portion, and wherein the fastening part is relatively slidable with respect to the first portion.

3. The wearable device of claim 1, wherein the first portion passes between the fastening part lower member and the cover.

4. The wearable device of claim 1, wherein the fastening part further includes a pin, wherein a fastening part hole is defined in a side surface of the fastening part, wherein a cover hole is defined in the cover, and the pin is coupled through the fastening part hole and the cover hole, and wherein the cover is configured to rotate about the pin as an axis with respect to the fastening part lower member.

5. The wearable device of claim 4, wherein the cover further includes a first friction member and a second friction member.

6. The wearable device of claim 5, wherein the first friction member restricts movement of the first portion in the first state, and the first portion in the second state is movable.

7. The wearable device of claim 6, wherein the second friction member restricts an angle between the cover and the fastening part lower member in the second state to be equal to or less than a specified value, and wherein the specified value is greater than 0 degrees and less than 90 degrees.

8. The wearable device of claim 1, wherein the fastening part further defines a fastening part fitting groove, and wherein the opposite end of the second portion is fixed in the fastening part fitting groove.

9. The wearable device of claim 1, wherein the fastening part further includes a fastening part upper member over the fastening part lower member, wherein a cover opening/closing groove is defined on the cover, and a fastening part opening/closing groove is defined on the fastening part upper member.

10. The wearable device of claim 1, wherein the strap part is made of at least one of a metal or a non-metal.

11. A wearing member comprising:

a strap part including a first portion and a second portion extending from the first portion; and a fastening part slidable along the first portion, wherein the first portion extends from one end thereof and passes through the fastening part, and an opposite end of the first portion is connected to the second portion, wherein the second portion includes one end extending from the first portion, and an opposite end coupled with the fastening part, wherein the fastening part includes a cover including a magnet, and a fastening part lower member, wherein the cover is configured to provide a first state and a second state, wherein in the first state the magnet of the cover is spaced apart from the first portion, and the fastening part is slidable along the first portion, and wherein in the second state the first portion is in contact with the magnet and the fastening part lower member, and the fastening part is fixed to the first portion.

12. The wearing member of claim 11, wherein at least part of the second portion is disposed to oppose at least part of the first portion, and is relatively slidable with respect to the at least part of the first portion, and wherein the fastening part is relatively slidable with respect to the first portion.

13. The wearing member of claim 11, wherein the first portion passes between the fastening part lower member and the cover.

14. The wearing member of claim 11, wherein the fastening part further includes a pin, wherein a fastening part hole is defined in a side surface of the fastening part, wherein a cover hole is defined in the cover, wherein the pin is coupled through the fastening part hole and the cover hole, and wherein the cover is configured to rotate about the pin as an axis with respect to the fastening part lower member.

15. The wearing member of claim 14, wherein the cover further includes a first friction member and a second friction member.

16. The wearing member of claim 15, wherein the first friction member restricts movement of the first portion in the first state, and the first portion in the second state is movable.

17. The wearing member of claim 16, wherein the second friction member restricts an angle between the cover and the fastening part lower member in the second state to be equal to or less than a specified value, and wherein the specified value is greater than 0 degrees and less than 90 degrees.

18. The wearing member of claim 11, wherein the fastening part further defines a fastening part fitting groove, and wherein the opposite end of the second portion is fixed in the fastening part fitting groove.

19. The wearing member of claim 11, wherein the fastening part further includes a fastening part upper member over the fastening part lower member, wherein a cover opening/closing groove is defined on the cover, and a fastening part opening/closing groove is defined on the fastening part upper member.

20. The wearing member of claim 11, wherein the strap part is made of at least one of a metal or a non-metal.

* * * * *